US006659006B2

(12) United States Patent
Brennan et al.

(10) Patent No.: US 6,659,006 B2
(45) **Date of Patent: *Dec. 9, 2003**

(54) TENSION CONTROL DEVICE FOR A PRINTING PRESS

(75) Inventors: Kenneth R. Brennan, Westmont, IL (US); Theodore Costopolous, Lisle, IL (US); Frederick J. Whiting, Burr Ridge, IL (US); Thaddeus A. Niemiro, Lisle, IL (US); Xin Xin Wang, Naperville, IL (US)

(73) Assignee: Goss Graphic Systems Inc., Westmont, IL (US)

( * ) Notice: Subject to any disclaimer, the term of this patent is extended or adjusted under 35 U.S.C. 154(b) by 53 days.

This patent is subject to a terminal disclaimer.

(21) Appl. No.: 09/939,355

(22) Filed: Aug. 24, 2001

(65) Prior Publication Data

US 2002/0083854 A1 Jul. 4, 2002

(Under 37 CFR 1.47)

Related U.S. Application Data

(63) Continuation-in-part of application No. 09/294,921, filed on Apr. 19, 1999, now abandoned, which is a continuation of application No. 08/908,008, filed on Aug. 11, 1997, now Pat. No. 5,894,797, which is a continuation of application No. 08/734,552, filed on Oct. 17, 1996, now abandoned, which is a continuation of application No. 08/521,157, filed on Aug. 30, 1995, now abandoned.

(51) Int. Cl.[7] ..... B41F 13/56; B65H 23/02; G01N 21/86

(52) U.S. Cl. ..... 101/225; 101/485; 226/3; 226/20; 226/29; 226/38; 226/45; 250/548

(58) Field of Search ..... 101/219, 225, 101/226, 227, 228, 232, 485, 181; 226/3, 20, 29, 38, 40, 42, 44, 45, 195, 15; 250/548, 559.01

(56) References Cited

U.S. PATENT DOCUMENTS

| | | | | |
|---|---|---|---|---|
| 3,912,145 | A | 10/1975 | Meihofer | 226/44 |
| 4,065,067 | A | 12/1977 | Martinez | 242/58.1 |
| 4,069,959 | A | 1/1978 | Bartell et al. | 226/21 |
| 4,147,104 | A | 4/1979 | Zernov et al. | 101/181 |
| 4,253,597 | A | 3/1981 | Waffner | 226/40 |
| 4,341,335 | A | 7/1982 | Schmid | 226/195 |

(List continued on next page.)

FOREIGN PATENT DOCUMENTS

| | | |
|---|---|---|
| CH | 605 367 | 9/1978 |
| DE | 1 250 228 | 9/1967 |
| DE | 26 44 298 | 7/1977 |
| DE | 94 06 068.1 | 6/1994 |
| EP | 649 927 A2 | 4/1995 |

(List continued on next page.)

OTHER PUBLICATIONS

Herbert L. Weiss, "Control System for Web–Fed Machinery," Guide to the Design, Selection & Usage of Hydraulic, Pneumatic and Electronics Control Systems for Web Feb Machinery, pp. 294–300, 1983.

*Primary Examiner*—Eugene H. Eickholt
(74) *Attorney, Agent, or Firm*—Marshall, Gerstein & Borun LLP

(57) ABSTRACT

A tension control device for a printing press having an adjustment roller, with a web of the press passing from a supply roll of the web to the adjustment roller. Means are provided for measuring the tension on opposed sides of the web passing downstream from the adjustment roller, and means are provided responsive to the measuring means for automatically approximately equalizing the tension of the web by adjustment of the adjustment roller on one end only of the adjustment roller.

20 Claims, 4 Drawing Sheets

U.S. PATENT DOCUMENTS

| | | | | | |
|---|---|---|---|---|---|
| 4,500,045 | A | * | 2/1985 | Whitaker et al. | 226/20 |
| 4,527,069 | A | * | 7/1985 | Pfizenmaier | 250/548 |
| 4,566,353 | A | | 1/1986 | Stiff | 74/710.5 |
| 4,569,285 | A | | 2/1986 | Forno et al. | 101/248 |
| 4,610,739 | A | * | 9/1986 | Jensen | 226/3 |
| 4,657,164 | A | | 4/1987 | Felix | 226/42 |
| 4,691,579 | A | | 9/1987 | Ekola | 73/862.48 |
| 4,796,474 | A | | 1/1989 | Koenig | 73/862.48 |
| 4,888,717 | A | * | 12/1989 | Ditto et al. | 226/3 |
| 4,896,808 | A | | 1/1990 | Bolza-Schunemann et al. | 226/42 |
| 4,955,265 | A | | 9/1990 | Nakagawa et al. | 83/74 |
| 4,990,215 | A | * | 2/1991 | Anderson | 226/15 |
| 5,050,812 | A | | 9/1991 | Mueller | 242/58.1 |
| 5,087,318 | A | * | 2/1992 | Anderson | 226/15 |
| 5,269,222 | A | | 12/1993 | Johnson et al. | 101/228 |
| 5,419,509 | A | | 5/1995 | Krayenhagen | 242/419 |
| 5,438,926 | A | | 8/1995 | Hudyma et al. | 101/227 |
| 5,505,129 | A | | 4/1996 | Greb et al. | 101/219 |
| 5,816,152 | A | * | 10/1998 | Nelgner et al. | 101/485 |
| 5,894,797 | A | * | 4/1999 | Brennan et al. | 101/226 |
| 5,996,492 | A | * | 12/1999 | Jurewitz et al. | 101/228 |
| 6,053,107 | A | * | 4/2000 | Hertel et al. | 101/485 |
| 6,314,333 | B1 | * | 11/2001 | Rajala et al. | 226/44 |
| 2002/0108983 | A1 | * | 8/2002 | Cote et al. | 226/42 |

FOREIGN PATENT DOCUMENTS

| | | |
|---|---|---|
| FR | 1 597 315 | 6/1970 |
| GB | 410 859 | 6/1934 |
| JP | 63 278880 | 11/1988 |
| JP | 21 63255 | 6/1990 |
| WO | WO 95 11183 | 4/1995 |

* cited by examiner

TENSION CONTROL DEVICE FOR A PRINTING PRESS

RELATED APPLICATION

This is a continuation-in-part of U.S. application Ser. No. 09/294,921, filed Apr. 19, 1999 now abandoned, which is a continuation of U.S. application Ser. No. 08/908,008, filed Aug. 11, 1997, now U.S. Pat. No. 5,894,797, which is a continuation of U.S. application Ser. No. 08/734,552, filed Oct. 17, 1996, now abandoned, which is a continuation of U.S. application Ser. No. 08/521,157, filed Aug. 30, 1995, now abandoned.

FIELD OF THE INVENTION

The invention relates to tension control devices for a printing press.

BACKGROUND OF THE INVENTION

Before the present invention, multi-color printing units have been used in a printing press to print colored images on a paper web. The webs used in the press unwind the web from a supply roll, and may be centered on the rollers of the press or may be positioned off-center. Due to the relatively fast speed of the press, the rolls have been completely unwound in a relatively short period of time, such as 15 minutes.

In accordance with prior practice, a new roll of the web is pasted onto the web of the previous roll when it is almost depleted. However, the rolls each have different characteristics, such as different manufacture and different winding tensions. As a result, the tension on opposed sides of the new web becomes significantly different, causing loss of registration in the press and flapping of the web, which may cause a web break.

Adjustments must be made to the press in the event of loss of registration, and due to the relative frequency of web pasting. Such adjustments result in loss of press time, wasted product, and inconvenience to the operator of the press.

SUMMARY OF THE INVENTION

In accordance with certain aspects of the present invention, a tension control device is provided for a printing press. The device includes an adjustment roller, with a web of the press passing from a supply roll of the web to the adjustment roller. Means are provided for measuring the tension on opposed sides of the web passing downstream from the adjustment roller. Means responsive to the measuring means are provided for automatically approximately equalizing the tension of the web by adjustment of the adjustment roller on one end only of the adjustment roller.

In accordance with additional aspects of the present invention, a tension control device is provided for a printing press. The device includes an adjustment roller and a tension roller positioned downstream of the adjustment roller, with a web of the press passing from a supply roll to the adjustment roller and tension roller, wherein the web is positioned off-center with respect to the adjustment roller and tension roller. Means are provided for measuring the tension on opposed ends of the tension roller, wherein a tension differential is detected at the opposed ends of the tension roller when the tension at opposed sides of the web are substantially equal. Means responsive to the measuring means are provided for automatically approximately equalizing the tension at opposed sides of the web by adjusting the adjustment roller on one end only of the adjustment roller to maintain the tension differential.

In accordance with further aspects of the present invention, a tension control device is provided for a printing press having a web. The device includes an adjustment roller and a tension roller located downstream of the adjustment roller, wherein the web passes over the adjustment roller and tension roller. A pair of transducers are provided for measuring tension at opposed ends of the tension roller, and means are provided for adjusting one end only of the adjustment roller. A controller controls the adjusting means in response to the transducers to approximately equalize tension on opposed sides of the web.

DESCRIPTION OF THE PREFERRED EMBODIMENTS

Figure 1:
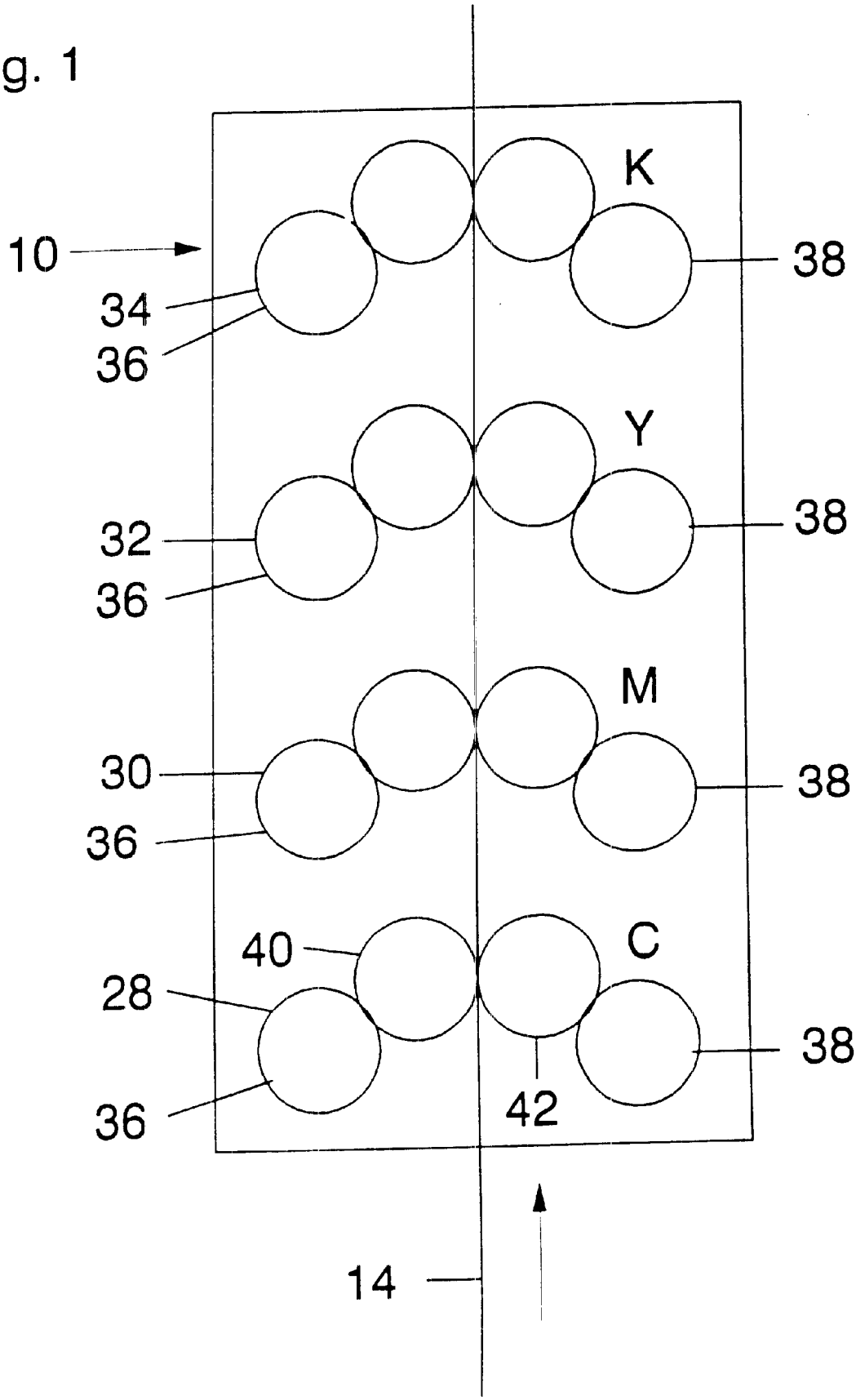
FIG. 1 is a diagrammatic view of a printing press for use with a tension control device of the present invention.

Referring now to FIG. 1, there is shown a printing press generally designated 10 for printing an image on a paper web 14. The press 10 has a plurality of printing units 28, 30, 32, and 34 for printing different colors of ink on the web 10. As shown, the printing unit 28 may print an ink having a color Cyan C, the printing unit 30 may print an ink having a color Magenta M, the printing unit 32 may print an ink having the color Yellow Y, and the printing unit 34 may print an ink having a color Black K in a four-color press 10.

The printing units 28, 30, 32, and 34 each have a plurality of print rolls or cylinders 36 associated with a blanket cylinder or roll 40. During printing by the press 10, an image of the ink is transferred from the print rolls 36 to the associated blanket rolls 40 to print the image on one surface of the web 14. In addition, the press 10 may have a plurality of printing units having a plurality of print rolls 38 associated with a plurality of blanket rolls or cylinders 42 on an opposed surface of the web 14 in order to transfer the ink image from the print rolls 38 to the blanket rolls 42 for printing an image on the other surface of the web 14. The following description of the print rolls is equally applicable to either the print rolls 36 or the print rolls 38 on the opposed surfaces of the web 14.

Figure 2:
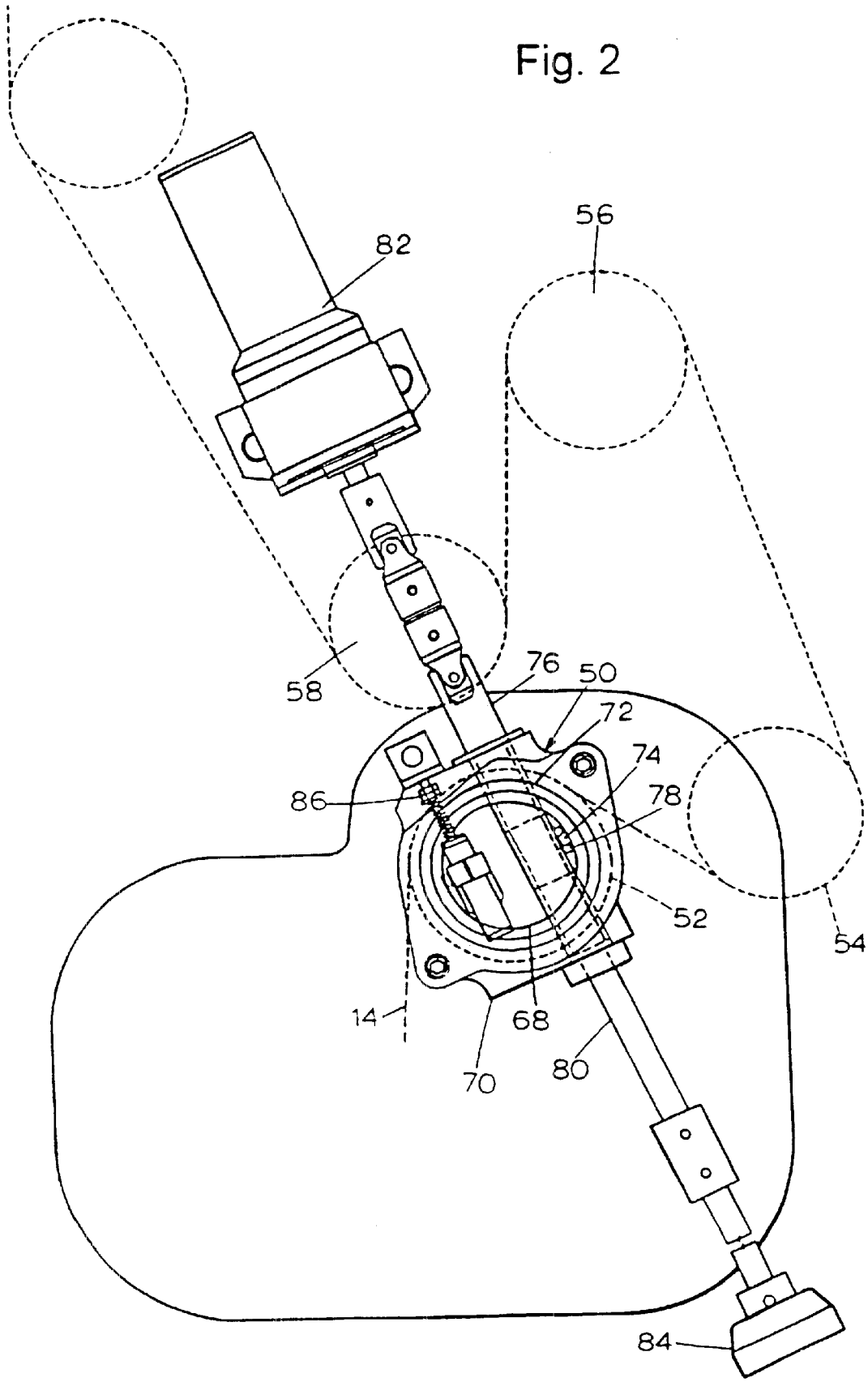
FIG. 2 is a side elevation view of the tension control device.

With reference to FIG. 2, the press 10 has a device 50 for controlling tension of the web 14 of the press 10. As shown, the web 14 passes from a supply roll around an adjustment roller 52 to a tension roller 54. The web 14 passes from the tension roller 54 around a dancer roller 56 to an idler roller 58 and then to the printing units of the press 10.

Figure 4:
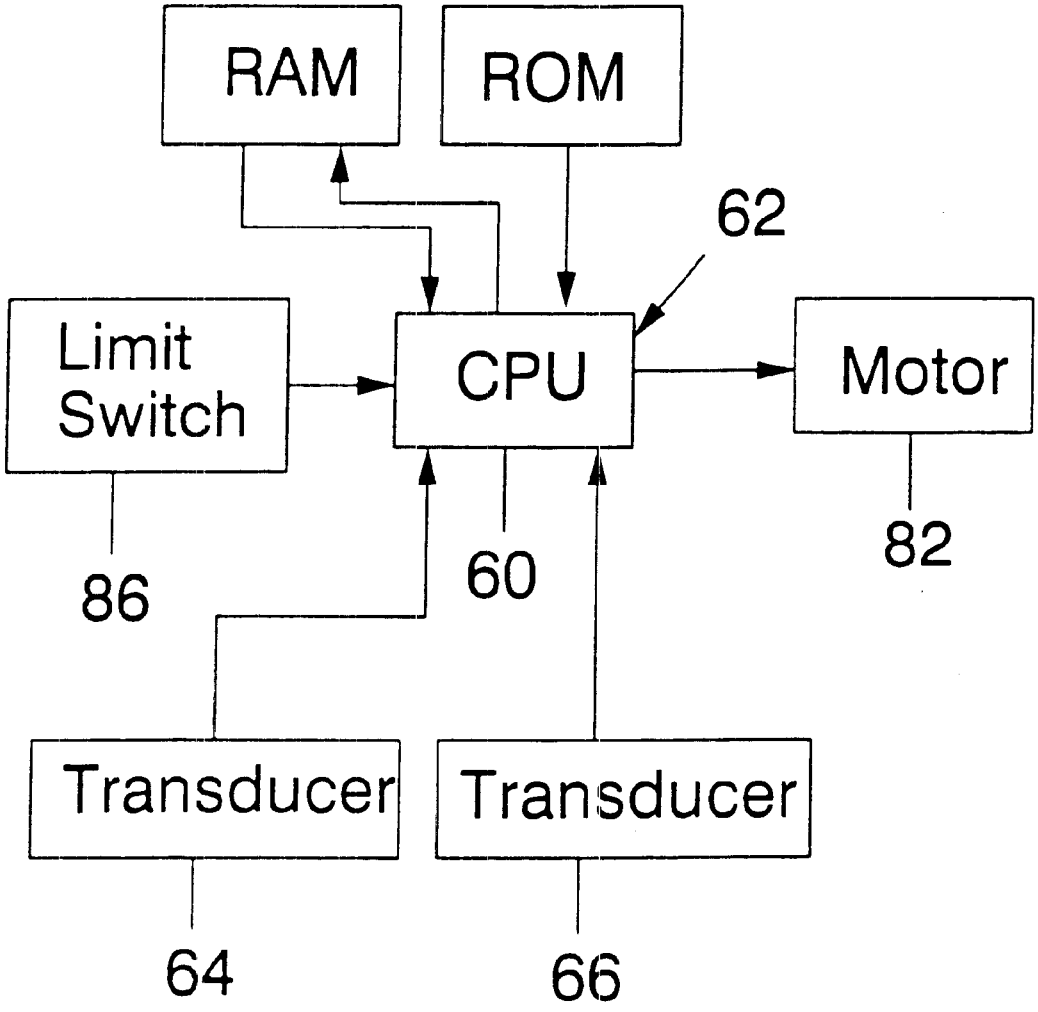
FIG. 4 is a block diagram of a control system of the tension control device of FIG. 2.

With reference to FIG. 4, the press 10 has a control system 62 having a computer 60 or Central Processing Unit (CPU) having a Random Access Memory (RAM) and Read Only Memory (ROM). As will be seen below, the control system 62 controls operation of the device 50, as shown in FIG. 2.

Figure 3:
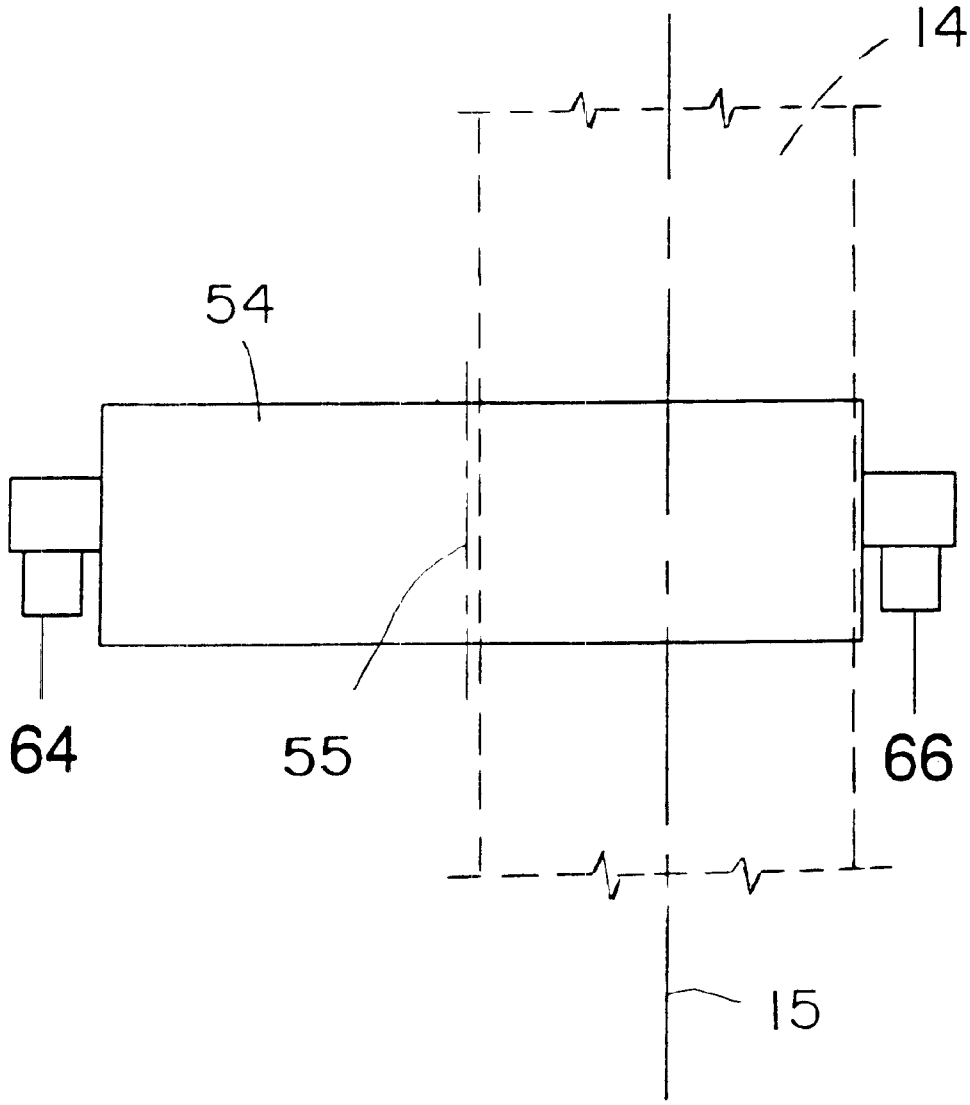
FIG. 3 is a diagrammatic view of a tension roller for the device of FIG. 2.

As shown in FIGS. 2 and 3, the tension roller 54 has transducers 64 and 66 on opposed ends of the tension roller 54. The transducers 64 and 66 are of known type, and measure the tension caused by the web 14 on opposed ends of the tension roller 54.

With reference to FIG. 2, the adjustment roller 52 has a bearing cup 68 on one end only of the adjustment roller 52, along with a bearing housing 70 for the cup 68. The bearing housing 70 has a bore 72 having inwardly directed helical teeth 74. The device 50 has an elongated shaft 76 having outwardly directed helical teeth 78 which mesh with the teeth 74. The device 50 has an elongated shaft 80 having the teeth 78 in the region of the bearing housing 70, while the housing 70 has the teeth 74 which mesh with the teeth 78 of the shaft 80. Thus, rotation of the shaft 80 causes a displacement of the bearing cup 68. In this manner, the tension of the web 14 on the one end of the adjustment roller 52 may be adjusted, which takes place automatically since the shaft 80 is rotated by a two-speed motor 82 attached to the shaft 80. The device 50 also has an elongated hand wheel 84 attached to an opposed end of the shaft 80 relative to the motor 82 in order to make manual adjustments to the shaft 80, with the automatic system off, if desired.

The device 50 may be operated to sense a difference in tension on the transducers 64 and 66 and to equalize the tensions on opposed sides of the web 14. When the web 14 is substantially centered on the tension roller 54, it is desired to obtain an identical tension on the opposed ends of the tension roller 54 in order to compensate for the paste of the web 14 from a depleted roll of web 14 to a new roll of the web 14. The condition of pasting a new roll of web 14 usually causes the device 50 to determine a different tension on the transducers 64 and 66.

In the event of the differing tension of the transducers 64 and 66, the device 50 actuates the motor 82 to rotate the shaft 80 and cause displacement of the bearing cup 68 and the one end of the adjustment roller 52. The motor 82 operates on the shaft 80 in a direction which will minimize the difference in tension on the transducers 64 and 66 of the tension roller 54. In this manner, the press 10 compensates for the web paste and minimizes the occurrence of the loss of registration and flapping of the web 14 due to the web pastes.

In certain situations where the web 14 is off-center, such as when running a partial web, the device 50 may also be operated to maintain substantially equal tensions at opposed sides of the web 14 by detecting tension on the transducers 64 and 66 and maintaining a pre-set tension differential between the opposed ends of the tension roller 54. When a partial web is run, the web 14 is often positioned to one end of the rollers, as shown in phantom in FIG. 3. Consequently, the longitudinal centerline 15 of the web 14 is spaced from a center 55 of the tension roller 54. For example, the web centerline 15 may be closer to the right end of the tension roller 54, as shown in FIG. 3, and therefore closer to the transducer 66. As a result, when the tension at opposed sides of the web 14 is substantially equal, the tension measured at transducer 66 is greater than the tension measured at transducer 64. It is desirable, however, to maintain the tension differential at the ends of the tension roller 54 so that the web tension is substantially equalized.

The desired tension differential when running an off-center web is primarily a function of web width and web position on the tension roller 54. Assuming, for example, that the web 14 is a partial web having a width approximately equal to one-half the width of the tension roller 54, and that the partial web is positioned so that its right side is substantially even with the right of the tension roller 54, as shown in FIG. 3. In this example, the longitudinal centerline 15 of the web 14 passes over the tension roller 54 at a point midway between the center 55 of the tension roller and the right end of the tension roller. As a result, the distance from the centerline of the web 14 to the right end is approximately one-fourth of the total width of the tension roller 54, while the distance from the web centerline 15 to the left end of the tension roller 54 is three-fourths of the tension roller width. It is expected that the measured tensions on the ends of the tension roller 54 should be roughly inversely proportional to the distances from the web centerline 15 to the ends of the tension roller, or 3:1 in the stated example. Accordingly, the tension measured at the right transducer 66 should be approximately three times the tension measured at the left transducer 64.

The tension differential approximation may be affected by several additional factors, such as the geometry of the rollers, whether the web 14 is wound evenly across the roller, and other considerations, and therefore the relationship between tension and web position is not necessarily linear.

In any event, once the desired tension differential is determined, the CPU 60 may be programmed to adjust one end of the tension roller 54 so that the tension differential at the transducers 64 and 66 is maintained. If the tensions measured at the transducers 64 and 66 produce a differential other than the desired value, the device 50 actuates the motor 82 to adjust the shaft 80 as noted above, thereby to obtain the desired tension differential.

As shown in FIG. 2, the device 50 also has a limit switch 86 which signals the computer 60 in the event that a predetermined limit on adjustment of the adjustment roller 52 takes place, in which case the motor 82 is deactivated.

The transducers 64 and 66 can measure when the web 14 is initially pasted due to relatively high fluctuation of the tension on opposed ends of the tension roller 54. In this case, the motor 82 runs at a first fast speed in order to make coarse corrections to the one end of the adjustment roller 52 as controlled by the CPU. Once the coarse corrections have been made by the motor 82, the CPU causes the motor 82 to move at a second slow rate in order to make fine adjustments to the one end of the adjustment roller 52. In this manner, the one end of the adjustment roller may be adjusted in a rapid and accurate manner.

Fine adjustments are made as the expiring roll decreases to adjust for small variations in tension.

Although certain exemplary apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A tension control device for a printing press, comprising:

an adjustment roller, with a web of the press passing from a supply roll of the web to the adjustment roller;

means for measuring the tension on opposed sides of the web passing downstream from the adjustment roller; and means responsive to the measuring means for automatically approximately equalizing the tension of the web by adjustment of the adjustment roller on one end only of the adjustment roller.

2. The device of claim 1, in which the measuring means comprise a pair of transducers positioned at opposed ends of a tension roller located downstream of the adjustment roller.

3. The device of claim 2, in which the web is substantially centered on the tension roller and the equalizing means adjusts the one end of the adjustment roller until the transducers report substantially equal tension values.

4. The device of claim 2, in which the web is offset with respect to the tension roller and the equalizing means adjusts the one end of the adjustment roller to maintain a predetermined tension differential between tension values reported by the transducers.

5. The device of claim 4, in which the predetermined tension differential is a function of a width of the web and a position of the web with respect to the tension roller.

6. The device of claim 4, in which tension values measured at opposed ends of the tension roller are approximately inversely proportional to respective distances between a center of the web and each end of the tension roller.

7. The device of claim 1, in which the equalizing means comprises a motor.

8. The device of claim 7, in which the motor has a plurality of speeds to modify the rate of adjustment of the adjustment roller.

9. The device of claim 1, further comprising a limit switch to control excessive adjustments of the adjustment roller.

10. A tension control device for a printing press, comprising:

an adjustment roller;

a tension roller positioned downstream of the adjustment roller, with a web of the press passing from a supply roll to the adjustment roller and tension roller, wherein the web is positioned off-center with respect to the adjustment roller and tension roller;

means for measuring the tension on opposed ends of the tension roller, wherein a tension differential is detected at the opposed ends of the tension roller when tension at opposed sides of the web are substantially equal; and means responsive to the measuring means for automatically approximately equalizing the tension at opposed sides of the web by adjusting the adjustment roller on one end only of the adjustment roller to maintain the tension differential.

11. The device of claim 10, in which the tension differential is a function of a width of the web and a position of the web with respect to the tension roller.

12. The device of claim 10, in which tension values measured at opposed ends of the tension roller are approximately inversely proportional to respective distances between a center of the web and each end of the tension roller.

13. The device of claim 10, in which the measuring means comprise a pair of transducers positioned at the opposed ends of the tension roller.

14. A tension control device for a printing press having a web, comprising:

an adjustment roller and a tension roller located downstream of the adjustment roller, wherein the web passes over the adjustment roller and tension roller;

a pair of transducers for measuring tension at opposed ends of the tension roller;

means for adjusting one end only of the adjustment roller; and a controller for controlling the adjusting means in response to the transducers to approximately equalize tension on opposed sides of the web.

15. The device of claim 14, in which the web is substantially centered on the tension roller and the controller operates the adjusting means until the transducers report substantially equal tension values.

16. The device of claim 14, in which the web is offset with respect to the tension roller and the controller operates the adjusting means to maintain a pre-determined tension differential between tension values reported by the transducers.

17. The device of claim 16, in which the pre-determined tension differential is a function of a width of the web and a position of the web with respect to the tension roller.

18. The device of claim 16, in which in which tension values measured at opposed ends of the tension roller are approximately inversely proportional to respective distances between a center of the web and each end of the tension roller.

19. The device of claim 14, in which the adjusting means comprises a motor.

20. The device of claim 19, in which the motor has a plurality of speeds to modify the rate of adjustment of the adjustment roller.

* * * * *

UNITED STATES PATENT AND TRADEMARK OFFICE

CERTIFICATE OF CORRECTION

PATENT NO. : 6,659,006 B2 
DATED : December 9, 2003
INVENTOR(S) : Brennan et al.

It is certified that error appears in the above-identified patent and that said Letters Patent is hereby corrected as shown below:

Column 6,
Line 29, please delete "in which in which tension values" and insert -- in which tension values --.

Signed and Sealed this

Sixteenth Day of March, 2004

JON W. DUDAS
*Acting Director of the United States Patent and Trademark Office*